US005179249A

United States Patent [19]

Bement et al.

[11] Patent Number: 5,179,249

[45] Date of Patent: Jan. 12, 1993

[54] PERFORMANCE OF BLASTING CAPS

[75] Inventors: Laurence J. Bement, Newport News, Va.; Morry L. Schimmel, St. Louis, Mo.; Ronnie B. Perry, Hampton, Va.

[73] Assignee: The United States of America as represented by the Administrator of the National Aeronautics and Space Administration, Washington, D.C.

[21] Appl. No.: 682,151

[22] Filed: Apr. 5, 1991

[51] Int. Cl.[5] ..... F42B 3/11

[52] U.S. Cl. ..... 102/202.14; 102/275.11

[58] Field of Search ..... 102/202.5, 202.7, 202.8, 102/202.9, 202.13, 202.14, 275.11, 701

[56] References Cited

U.S. PATENT DOCUMENTS

| | | | |
|---|---|---|---|
| 2,604,042 | 7/1952 | Cook | 102/275.11 |
| 3,169,482 | 2/1965 | Noble | 102/202.7 |
| 3,181,463 | 5/1965 | Morgan et al. | 102/202.7 |
| 3,274,937 | 9/1966 | Kyle | 102/202.7 |
| 3,570,403 | 3/1971 | Hawley | 102/202.9 |
| 3,726,217 | 4/1973 | Dedman et al. | 102/202.8 |
| 3,741,123 | 6/1973 | Dittrich | 102/275.11 |
| 4,614,156 | 9/1986 | Colle, Jr. et al. | 102/275.11 |
| 4,907,509 | 3/1990 | Lieberman | 102/202.5 |

FOREIGN PATENT DOCUMENTS

| | | | |
|---|---|---|---|
| 10487 | 4/1980 | European Pat. Off. | 102/202.5 |

*Primary Examiner*—Stephen M. Johnson
*Attorney, Agent, or Firm*—George F. Helfrich

[57] ABSTRACT

Common blasting caps are made from an aluminum shell in the form of a tube which is closed at both ends. One end, which is called the output end, terminates in a principal side or face, and contains a detonating agent which communicates with a means for igniting the detonating agent. The improvement of the present invention is a flat, steel foil bonded to the face in a position which is aligned perpendicularly to the longitudinal axis of the tube.

3 Claims, 1 Drawing Sheet

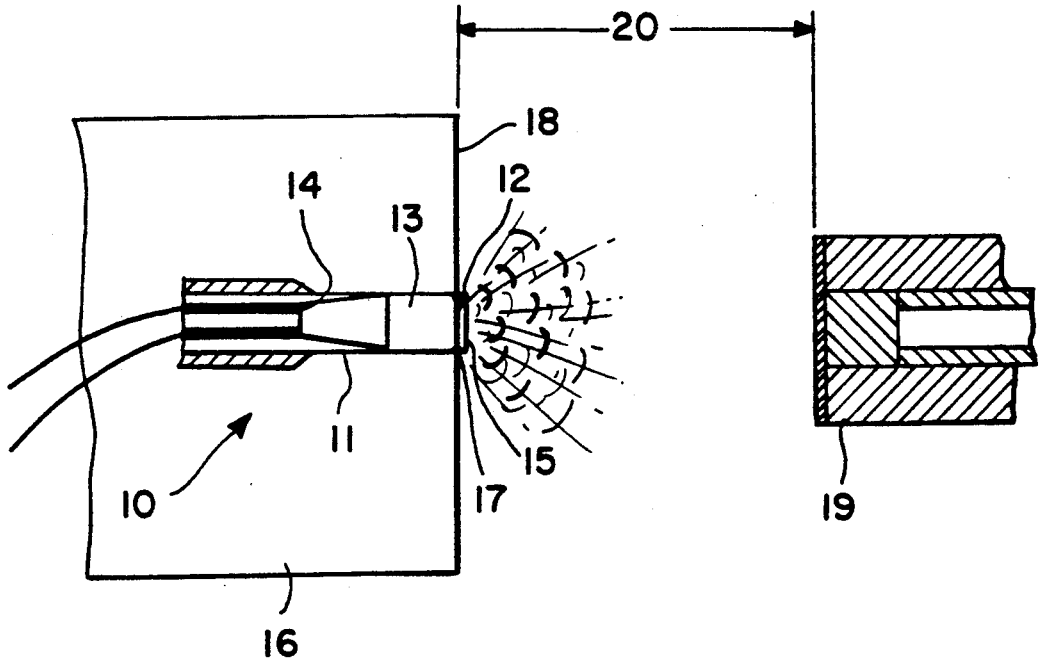
20
18
14
12
13
11
15
10
17
19
16

PERFORMANCE OF BLASTING CAPS

ORIGIN OF THE INVENTION

The invention described herein was jointly made by an employee of the United States Government and by contract employees in the performance of work under NASA contracts and is subject to the provisions of Section 305 of the National Aeronautics and Space Act of 1958, as amended, Public Law 85-568(72 Stat. 435; 42 USC 2457) and 35 U.S.C. 202. In accordance with 35 U.S.C. 202, the contractor elected not to retain title.

BACKGROUND OF THE INVENTION

1. Field of the Invention

The present invention relates generally to ammunition and explosives. It relates particularly to blasting caps, the performance of which is improved by the bonding of a flat, steel foil to the face of a blasting cap and perpendicular to its longitudinal axis.

2. Description of the Related Art

Ordinary blasting caps, which commonly include deep-drawn aluminum cups, produce fragment velocities of approximately 14,000 feet/second and very small, scattered impressions in witness blocks. Witness blocks are blocks of poly(methyl methacrylate) into which the face of a blasting cap is fired. The depth of penetration, as well as the pattern of the fragments are determined visually. Moreover, the donor initiation capability of such blasting caps (as measured by the maximum gap at which initiation can be achieved between a blasting cap and a standard HNS explosive acceptor) is in need of improvement, as a result of increased requirements in military and aerospace applications, and in such specialized industries as mining and exploration for oil.

Although U.S. Pat. No. 4,727,808 (Wang et al) discloses a steel-shelled explosive blasting cap and a cup made from soft steel sheet, and although U.S. Pat. No. 4,920,883 (Barker) discloses an exploding foil detonator, there is no disclosure in either of these references of the addition of a steel foil to an existing standard blasting cap, which is made of aluminum.

SUMMARY OF THE INVENTION

It is a primary object of the present invention to improve the performance of standard blasting caps, especially to increase the gap at which initiation can be achieved between a blasting cap and a standard explosive acceptor.

It is another primary object of the present invention to provide an improved blasting cap which has a flat, steel foil bonded to the face thereof, thereby providing enhanced initiation performance.

These and other objects and benefits are achieved by providing an improvement to a standard blasting cap, which is made from an aluminum shell in the form of a tube closed at both ends, one end thereof being the output end, which terminates in a principal side or face. The output end contains a detonating agent and means communicating therewith for igniting the detonating agent. The improvement of the present invention is a flat, steel foil bonded to the face in a position which is perpendicular to the longitudinal axis of the tube. Especially good results are achieved if the tube is encased in a block of metal, such as aluminum, the block having an opening or port therein which exposes the face of the blasting cap, and the flat, steel foil is bonded across the port in a position which is perpendicular to the axis of the tube. The flat, steel foil is preferably from about 0.001 to about 0.005 inches in thickness, with 0.005 inches being especially desirable.

BRIEF DESCRIPTION OF THE DRAWING

For a more complete understanding of the present invention, including its primary objects and attending benefits, reference should be made to the Detailed Description of the Preferred Embodiments, which is set forth below. This description should be read together with the accompanying drawing, the single figure of which schematically depicts a preferred embodiment of the improved blasting cap of the present invention, as well as an experimental setup to determine its initiation performance characteristics.

DESCRIPTION OF THE PREFERRED EMBODIMENTS

Referring now to the drawing, there is shown an improved blasting cap 10, according to the present invention, which has a tubular aluminum shell 11, an output end terminating in principal side or face 12, and detonating agent 13 which communicates with means 14 for igniting the detonating agent. (Electrical means is shown here. However, other means, such as safety fuse ignition are also common in the art.) Flat, steel foil 15 has been bonded to face 12 by standard means, such as the application of epoxy cement. Flat, steel foil 15 is applied so that it is perpendicular to the longitudinal axis of tubular aluminum shell 11.

Especially advantageous results are achieved when blasting cap 10 is encased in metal block 16, which has an opening or port 17 exposing face 12. Flat, steel foil 15 is bonded across planar surface 18 of block 16 in a position which is perpendicular to the longitudinal axis of tubular aluminum shell 11. By this expedient an essentially flat surface is maintained.

Also shown in the drawing is acceptor 19, which is spaced from blasting cap 10 according to the present invention by air gap 20. This acceptor 19 is used in experiments described in the following Example to determine the initiation performance of blasting cap 10, which is functioning as a donor.

EXAMPLE

A series of experiments were conducted on an aluminum-shelled blasting cap (2-grain PETN output) to determine whether performance could be improved. Steel foils with thickness of 0.001 inches to 0.005 inches were individually bonded directly to the curved end of the blasting cap and then to maintain a flat surface, were individually bonded across a port in an aluminum block containing the blasting cap. Performance was evaluated by measuring the velocities of the fragments produced, by obtaining patterns of fragments in transparent witness blocks, and by determining the maximum gap at which the blasting cap could initiate and explosion in a 0.156-inch (3.96 mm) diameter HNS explosive acceptor in a 0.005-inch (0.13 mm) thick steel cup. The greater the gap, the greater the demonstrated initiation capability of the donor.

Experimental results showed that the unmodified blasting caps produced fragments with velocities of 14,000 ft/s (4.3 km/s) and very small, scattered impressions in the witness blocks. The unmodified blasting caps initiated an explosion of the acceptor explosive at a maximum gap of 0.25 inches (6.4 mm). The blasting caps with directly bonded steel foil of 0.005 inches produced fragment velocities of 9,300 ft/s (2.8 km/s) with large craters and unpredictable patterns to such a degree that no attempts were made to initiate explosions.

The blasting caps bonded into aluminum blocks with flat, steel foils of 0.005 inches on the output faces produced fragments with velocities of 10,500 ft/s (3.2 km/s) with large, predictably located craters. The maximum gap for initiation of an explosion in an acceptor was 1.25-inches (31.8 mm).

Accordingly, it was concluded that flat, steel foil bonded to the face of a blasting cap perpendicular to its axis improves the performance of the cap up to a factor of five over that of a standard blasting cap. Thicknesses of 0.001 to 0.005 inches have shown utility, with 0.005 inches being the most preferred. The density of steel is about three times that of aluminum, and steel fragments are larger than those produced from aluminum cups which disintegrate in explosions into very small particles. This improved performance should be useful in military and aerospace applications and in such specialized industries as mining and exploration for oil.

What is claimed is:

1. In a blasting cap comprising an aluminum shell in the form of a tube, one end thereof being the output end terminating in a face, the output end containing a detonating agent therein which communicates with means for igniting the detonating agent, the improvement therein comprising a flat, steel foil having a thickness from about 0.001 to about 0.005 inches which is bonded to the face in a position which is aligned perpendicularly to the longitudinal axis of the tube.

2. The blasting cap of claim 1, wherein the flat, steel foil has a thickness of about 0.005 inches.

3. The blasting cap of claim 1, wherein the tube is encased in a metal block which has an opening or port therein which exposes the face, the flat, steel foil being bonded across the port in an alignment which is perpendicular to the longitudinal axis of the tube.

* * * * *